United States Patent [19]

Ushifusa et al.

[11] Patent Number: 4,727,741

[45] Date of Patent: Mar. 1, 1988

[54] CROSS-ROLLING MILL

[75] Inventors: Yoshinori Ushifusa; Shinji Takubo; Toshihiro Fukuzaki, all of Hiroshima, Japan

[73] Assignee: Mitsubishi Jukogyo Kabushiki Kaisha, Tokyo, Japan

[21] Appl. No.: 842,846

[22] Filed: Mar. 24, 1986

[30] Foreign Application Priority Data

Aug. 9, 1985 [JP] Japan ..... 60-173988

[51] Int. Cl.[4] ..... B21B 31/16

[52] U.S. Cl. ..... 72/237; 72/243; 72/245; 72/247

[58] Field of Search ..... 72/243, 245, 247, 237, 72/241, 199, 20, 21

[56] References Cited

U.S. PATENT DOCUMENTS 1,971,982 8/1934 Holeton ..... 72/247

4,453,393 6/1984 Hino et al. ..... 72/245 X

FOREIGN PATENT DOCUMENTS 0159202 10/1982 Japan ..... 72/241
0190704 11/1982 Japan ..... 72/237
0087914 5/1984 Japan ..... 72/237
0118311 6/1985 Japan ..... 72/247
0850239 7/1981 U.S.S.R. ..... 72/247

*Primary Examiner*—Lowell A. Larson
*Assistant Examiner*—Steve Katz
*Attorney, Agent, or Firm*—Wenderoth, Lind & Ponack

[57] ABSTRACT

A rolling mill has upper and lower rolls with axes which cross each other. These two rolls are pivoted at ends diametrically opposite to each other. Only rolls chocks mounted at the non-pivoted ends of the rolls are allowed to be hydraulically moved the same distance in the same direction, i.e., the rolling direction or the reverse direction, in a symmetrical relation with respect to the center line of the rolling mill.

6 Claims, 6 Drawing Figures

CROSS-ROLLING MILL

BACKGROUND OF THE INVENTION

1. Field of the Invention

The present invention relates to a cross-rolling mill having upper and lower rolls which are inclined at a small angle to each other and between which a strip is passed to roll the strip.

2. Description of the Related Art

As shown in FIG. 4, the axes of the upper and lower rolls of a prior art cross-rolling mill intersect each other at a point. Roll chocks mounted on the work side see (FIG. 3) and on the driver side, respectively, moved so that the intersection point is maintained on the center line (see Japanese Patent Laid-Open Nos. 195521/1982 and 64908/1980). In the prior art rolling mill, the two roll chocks are simultaneously moved to cause the axes of the upper and lower rolls to cross each other. Hence, the structure is complex and expensive to manufacture.

SUMMARY OF THE INVENTION

It is the object of the present invention to provide a rolling mill that is simple in structure and requires less maintenance than conventional rolling mills.

The above object is achieved by a rolling mill in which each of the upper and lower rolls is movable only about one end thereof which allows the axes of the two rolls cross each other. That is, when the rolls are moved, if the chock on the work side of the upper roll is pivoted, then the chock on the driver side of the lower roll is pivoted.

The movement of the axes of the rolls is shown in FIG. 1. Driver devices are provided to move each roll about its one end. When the driver devices are operated, the intersection point of the axes moves on the center line but does not leave it. Thus, the axes of the upper and lower rolls intersect each other. Therefore, the shape of the rolled strip can be controlled by varying the distance between the upper and lower rolls in a symmetrical relation with respect to the center line.

BRIEF DESCRIPTION OF THE DRAWINGS

FIG. 2(*b*) is a plan view partially in cross section of the lower roll of the mill depicted in FIG. 1;

FIG. 2(*c*) is a schematic illustrating an alternative system for crossing operation of the rolls;

DETAILED DESCRIPTION OF THE PREFERRED EMBODIMENT

Figure 2A:
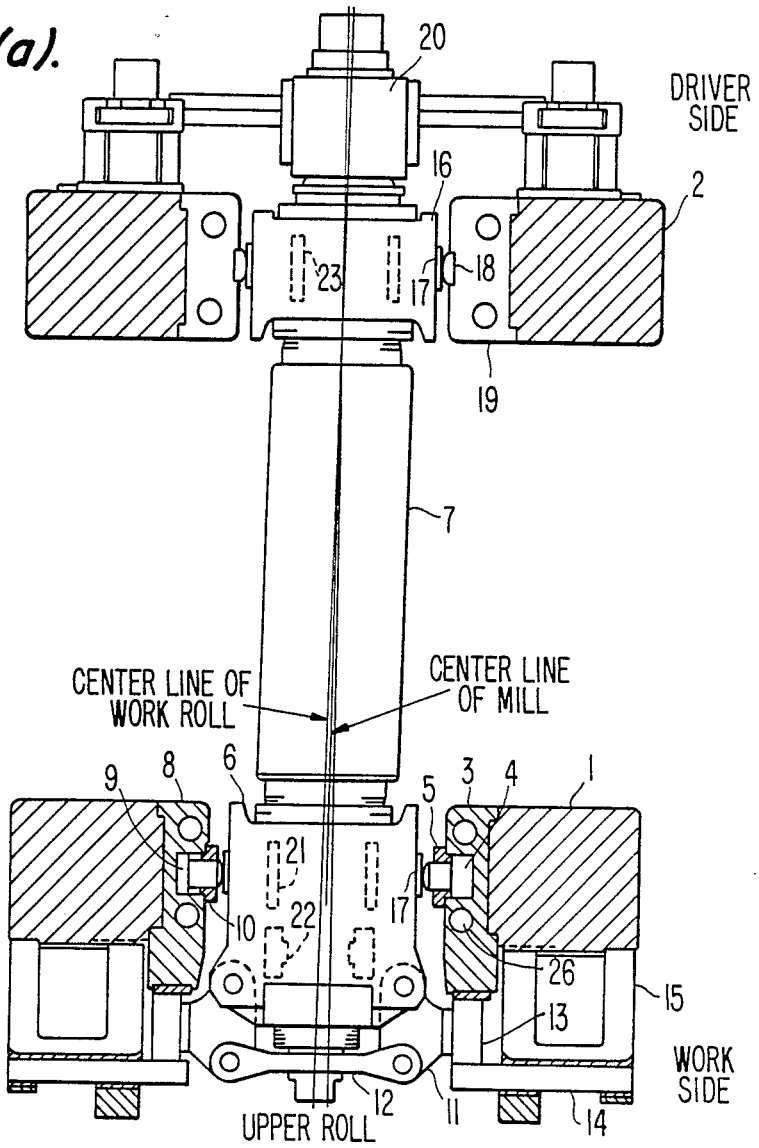
FIG. 2(*a*) is a plan view partially in cross section of the upper roll of the mill depicted in FIG. 1.
Figure 2B:
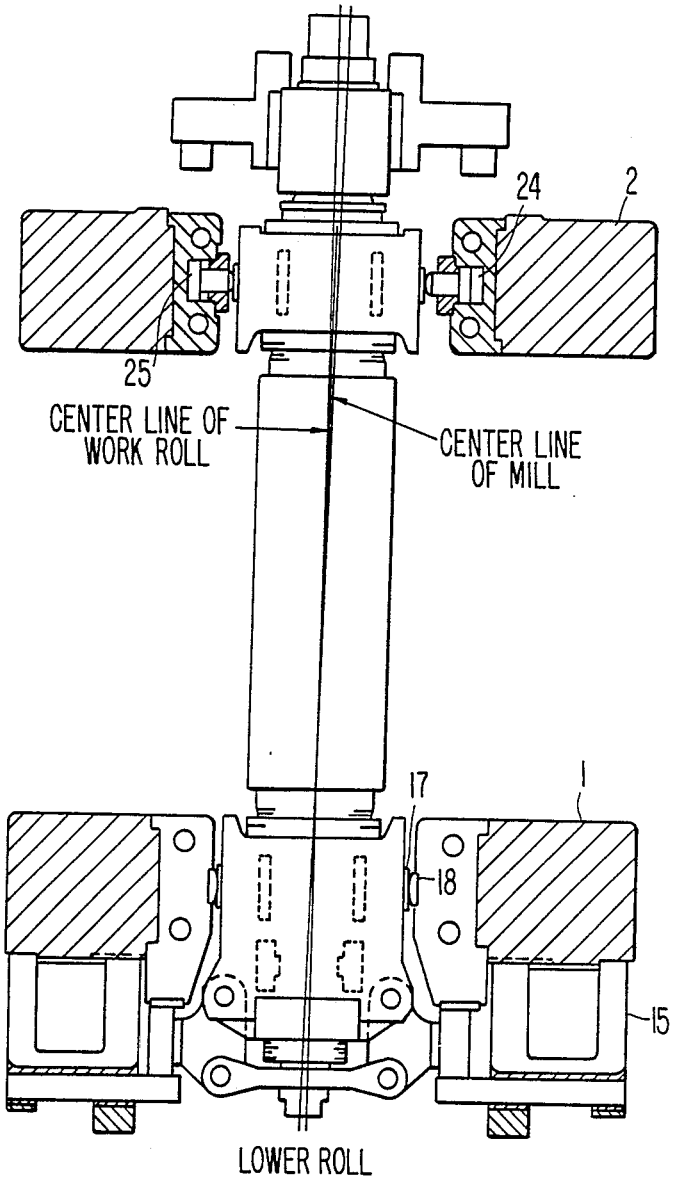
Figure 2C:
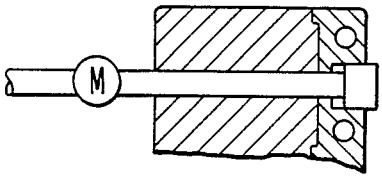
Figure 3:
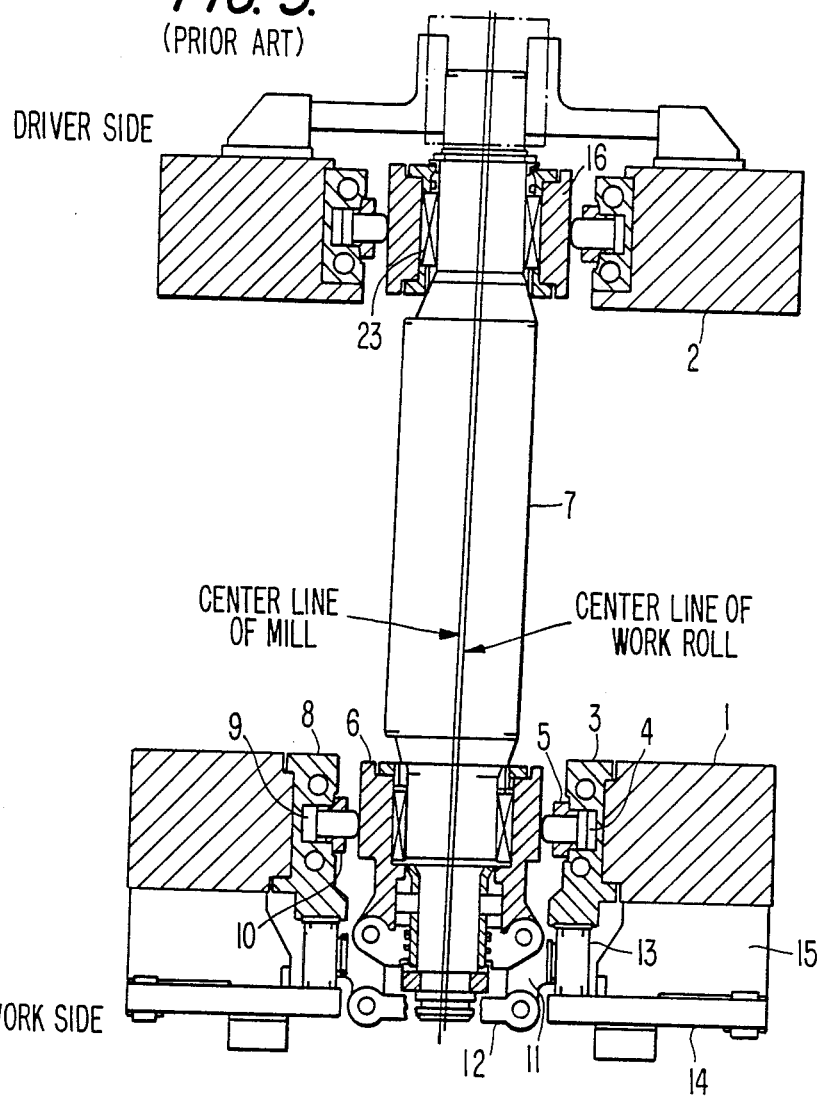
FIG. 3. (PRIOR ART)
FIG. 3 is a view similar to FIG. 2(*a*), but showing a prior art cross-rolling mill in which the angle that the center line of the work roll forms with the center line of the mill is zero.
Figure 4:
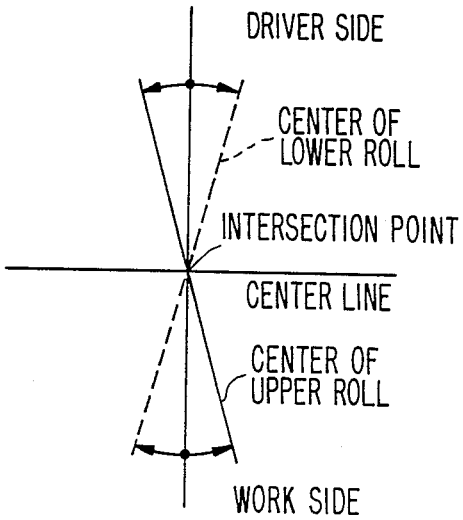
FIG. 4. (PRIOR ART)
FIG. 4 is a schematic representation of the rolls of the prior art cross-rolling mill of FIG. 3, showing the arrangement of the rolls.

Referring to FIGS. 2 and 3, there is shown a rolling mill embodying the concept of the present invention. This mill has a housing 1 on the work side, a second housing 2 on the driver side, a project block 3, a hydraulic cylinder plunger 4 for crossing operation, a hydraulic cylinder cover 5, a roll chock 6 on the work side, a work roll 7, a second project block 8, a second hydraulic cylinder plunger 9 for crossing operation, a second hydraulic cylinder cover 10, a lever 11, a link 12, a thrust pad 13, a clamp plate 14, a chock clamp body 15, a roll chock 16 on the driver side, a chock liner or flat liner 17, a housing liner or cylindrical liner 18, a project block 19, a spindle 20, radial bearings 21 on the work side, thrust bearings 22, radial bearings 23 on the driver side, further hydraulic cylinder plungers 24 and 25 for crossing operation, and hydraulic cylinders 26 for roll bending.

Referring specifically to FIG. 2, the upper roll 7 is held by a work roll-chock assembly mounted on the work side. This assembly comprises the work roll chock 6, the chock liner 17, the lever 11, the link 12, and the thrust pad 13. The work roll chock 6 incorporates the radial bearings 21 and the thrust bearings 22. The thrust pad 13 incorporates spherical bearings or spherical roller bearings (not shown), and cooperates with the lever 11 and the link 12 to constitute a thrust bearing mechanism that follows the crossing operation of the rolls.

The chock clamp body 15 is rigidly fixed to the side of the housing 1. The thrust bearing 13 is held between the clamp body 15 and the clamp plate 14, so that the bearing can be shifted back and forth to axially place the work roll in position. The project blocks 3 and 8 are rigidly attached to the inner surface of the opening formed in the housing 1. The block 3 incorporates the cylinder plunger 4, the cylinder cover 5, and the corresponding hydraulic cylinder 26 for roll bending. Similarly, the block 8 incorporates the cylinder plunger 9, the cylinder cover 10, and the corresponding cylinder 26.

The project block 19 is firmly mounted to the housing 2 on the driver side. This block 19 is equipped with no crossing cylinders, but incorporates only the cylinder for roll bending. The block 19 is connected to the chock liner 17 via the cylindrical liner 18. The work roll chock 16 on the driver side incorporates the radial bearings 23. The work roll 7 is rotated by the mill spindle 20. The lower roll has the crossing cylinders 24 and 25 disposed on the driver side in an opposite relation to those disposed on the upper roll. No crossing cylinders are provided on the work side. The roll chock and the project block are connected together via the flat liner and the cylindrical liner.

Figure 1:
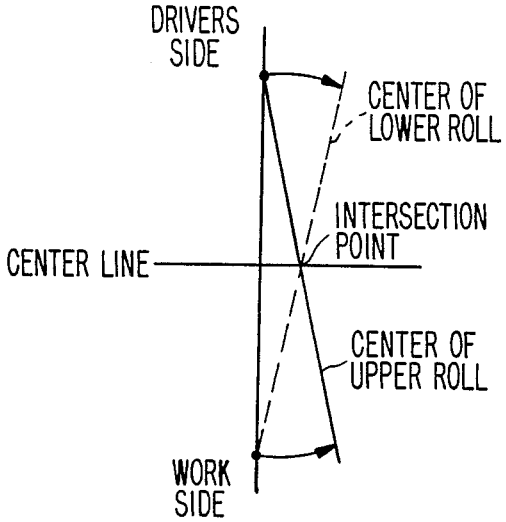
FIG. 1 is a schematic representation of the rolls of a cross-rolling mill according to the present invention, showing the arrangement of the rolls.

In the rolling mill constructed as described above, the upper roll crossing cylinders 4 and 9 on the work side are moved toward the exit end of the mill, and the lower roll crossing cylinders 24 and 25 are moved toward the exit end of the mill to produce the condition shown in FIG. 1, where the axes of the rolls cross each other when viewed in plan. This operation is enabled by the fact that the chock liner 17 on the driver side of the upper roll is a flat liner and that the housing liner 18 on the work side of the lower roll is a cylindrical liner. This crossing operation prevents the intersection point from moving awa from the center line. Therefore, the roll gap can be varied in a symmetrical relation with respect to the center line, according to the angle at which the axes of the rolls cross. Hence, the shape of the rolled material can be controlled according to the conditions of rolling.

In the present example, the rolls are moved in such a way that their axes cross each other by the actuation of hydraulic cylinders. The invention can also have a system, as shown in FIG. 2(*c*) where the axes of the rolls are made to cross each other on one side by electric motors. Also in the above example, the crossing cylinders are mounted on the work side of the upper roll and on the driver side of the lower roll, respectively. It is also possible to mount the crossing cylinders on the driver side of the upper roll and on the work side of the lower roll.

The novel rolling mill is simple in structure, requires less maintenance, and easily accommodates the foundation and other devices, such as a roll exchange device.

What is claimed is:

1. A cross-rolling mill comprising:

a first roll rotatably mounted in the mill about a rotational axis thereof, said first roll having a first end at a driver side of the mill and a second end at a work side of the mill;

a second roll rotatably mounted in the mill about a rotational axis thereof and coacting with said first roll for rolling a workpiece travelling in a rolling direction, the rotational axis of said first roll extending in a first plane that is parallel to a second plane in which the rotational axis of said second roll extends and a third plane in which the rolling direction extends, said second roll having a first end adjacent the first end of said first roll at the driver side of the mill and a second end adjacent the second end of said first roll at the work side of the mill, the mill having a center line passing through a point generally midway along the length of and between said first and second rolls and extending in a direction transverse to the direction in which said rolls extend, said first roll being pivotal in the mill in said first plane only about the first end thereof at the driver side of the mill, said second roll being pivotal in the mill in said second plane only about the second end thereof at the work side of the mill; and pivoting means for pivoting said first roll in the mill only about the first end thereof and said second roll only about the second end thereof so that an axis intersecting the center line of the mill and the rotational axes of said first and said second rolls is repositionable along the center line while continuing to intersect the center line.

2. A rolling mill as claimed in claim 1, and further comprising a first roll chock to which the second end of the first roll is mounted, said first roll chock being displaceable in the mill over a distance in both the rolling direction and a direction opposite to the rolling direction, and a second roll chock to which the first end of the second roll is mounted, said second roll chock being displaceable in the mill over a distance in both the rolling direction and the direction opposite to the rolling direction, and wherein said pivoting means comprises means for displacing said first roll chock and said second roll chock in the mill over the same said distance in the same one of said rolling direction and said direction opposite to the rolling direction.

3. A cross-rolling mill as claimed in claim 1, wherein each of the first end of said first roll and the second end of said second roll has a respective chock liner and a housing liner engaging the chock liner.

4. A cross-rolling mill as claimed in claim 3, wherein each respective chock liner is flat and each respective housing liner is cylindrical.

5. A cross-rolling mill as claimed in claim 2, wherein said means for displacing are hydraulic cylinders.

6. A cross-rolling mill as claimed in claim 2, wherein said means for displacing comprises electric motors.

* * * * *